US005401166A

United States Patent [19]

Mallek et al.

[11] Patent Number: 5,401,166

[45] Date of Patent: Mar. 28, 1995

[54] METHOD AND FURNACE FOR BURNING WASTE

[75] Inventors: Heinz Mallek, Linnich-Tetz; Winfried Brunner, Unterchaching; Wolfgang Schmidt, München, all of Germany

[73] Assignee: Wamsler Umwelttechnik GmbH, München, Germany

[21] Appl. No.: 115,134

[22] Filed: Sep. 1, 1993

[30] Foreign Application Priority Data

Sep. 10, 1992 [DE] Germany ..... 42 30 311.7

[51] Int. Cl.[6] ..... F27D 1/08

[52] U.S. Cl. ..... 432/96; 432/99; 110/315; 110/316

[58] Field of Search ..... 110/315, 316; 432/99, 432/96

[56] References Cited

U.S. PATENT DOCUMENTS

| | | | |
|---|---|---|---|
| 2,654,590 | 10/1953 | Molenaar | 432/99 |
| 3,544,091 | 12/1970 | Jaeger | 432/99 |
| 4,441,436 | 4/1984 | Hayashi | 110/316 |
| 4,562,777 | 1/1986 | van der Voort | 110/315 |
| 4,771,711 | 9/1988 | Pike | 110/316 |
| 4,797,092 | 1/1989 | Pieper | 432/96 |
| 5,247,892 | 9/1993 | Svensson | 110/316 |

FOREIGN PATENT DOCUMENTS

| | | |
|---|---|---|
| 2735139 | 2/1979 | Germany . |
| 2604409 | 12/1979 | Germany . |

*Primary Examiner*—Henry C. Yuen
*Attorney, Agent, or Firm*—Rogers & Killeen

[57] ABSTRACT

A method and a combustion furnace are provided by means of which waste which is predominantly of organic nature can be burnt effectively and uniformly. The combustion furnace comprises two bottlenecks, one above the other, constituted by rocking grates. The upper rocking grate essentially serves to subject the solids to pre-combustion, namely to drying, degasifying, and partial gasifying, and to supply the material uniformly in doses to the fire bed which is located on the lower grate and in which complete gasification takes place. Rotational movements of both grates provide for uniform passage of the material through the shaft without the risk of burn-through occurring along the edges so that the entire combustion process becomes highly uniform.

10 Claims, 1 Drawing Sheet

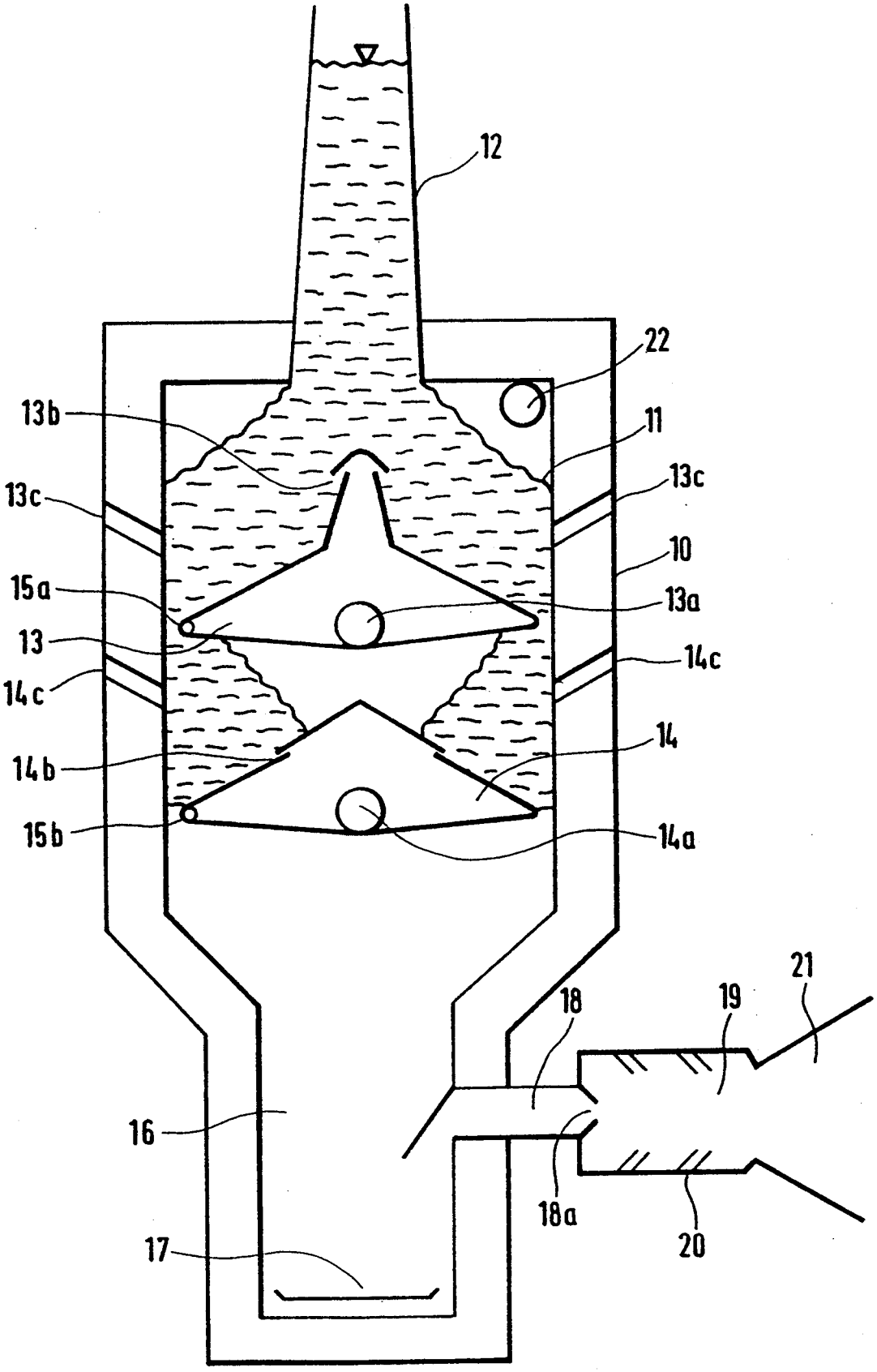
12
22
13b
11
13c
13c
10
15a
13a
13
14c
14c
14
14b
15b
14a
21
18
19
16
18a
20
17

METHOD AND FURNACE FOR BURNING WASTE

FIELD OF THE INVENTION

The instant invention relates to a method of burning and a combustion furnace for burning organic solids in the form of pieces, preferably waste material and for producing combustible gases such as recited in the pre-characterizing parts of claims 1 and 4, respectively.

BACKGROUND OF THE INVENTION

A method and an apparatus of the kind in question are known from DE-PS 26 04 409 and DE-OS 27 35 139.

The known processes and the known combustion furnaces serve to burn solid waste of the most diverse consistency in the ecologically most harmless way. And, indeed, that is possible because essentially the only resulting products of combustion are ashes and harmless exhaust gases.

SUMMARY OF THE INVENTION

It is the object of the instant invention to improve the known method in question and the known combustion furnace mentioned such that perfect combustion is warranted even at greater throughput of waste and a shaft cross section which is increased accordingly. It is another object of the invention to devise the combustion furnace so that it will be of compact and relatively simple structure. Yet another object of the invention resides in obtaining combustible gases whose properties and constancy of composition make them are suitable for power generation.

The objects are met, in accordance with the invention, by the features specified in claim 1 as far as the method is concerned and in claim 4 are regards the apparatus.

Two bottlenecks thus are provided according to the invention, one downstream of the other. In pratice these bottlenecks conveniently are embodied by rocking grates. The upper grate serves to accumulate the waste filled from the top into the shaft and supply it to the shaft space between the two bottlenecks in metered quantities. Above the top grate, the waste material is dried and degasified, and partly also gasified due to the reaction gases which are introduced in the region of the upper grate. Thereupon the waste material which reaches the space between the two bottlenecks and which has been dried, degasified, and partly gasified is accumulated by the lower grate and totally gasified, while further reaction gas is added, so as to form ashes and combustible gas. The ashes fall through the grate to the bottom, and the combutible gases likewise are withdrawn towards the bottom. It is convenient to cause the two grates to oscillate, as specified in claims 2 and 5, so as to carry out continuous or intermittent periodic rotational movements of limited amplitude. This makes sure that waste in pieces which has accumulated will slide down uniformly and that burning through along the edges and/or up to the top in the stack of waste material is avoided.

BRIEF DESCRIPTION OF THE DRAWING

Further advantages of the invention may be gathered from the description below of an embodiment of a combustion furnace according to the invention and from the accompanying drawing. The only figure is a vertical section through the combustion furnace.

DESCRIPTION OF THE PREFERRED EMBODIMENT

In the drawing, the combustion furnace is generally designated 10. An upright shaft 11 is disposed in the furnace. A pipe 12 for charging waste to be burnt opens from the top into the shaft. The shaft 11 includes two bottlenecks formed by grates 13 and 14. Grate 13 is a rocking grate which is pivotable about a central axis **13*a*, and the grate passage is of slotted configuration 15*a* defined, on the one hand, by the inside wall of the shaft 11 and, on the other hand, by the outer edge of the grate 13. The axis 13*a* is embodied by a hollow shaft, its interior being the supply conduit for reaction gas which flows through discharge openings 13*b* of the grate 13 into the interior of the shaft 11. The basic structure of such a rocking grate 13 being known, it is not described here in any greater detail. Reaction gas may be supplied in addition through conduits 13*c* and 14*c* formed in the shaft wall and opening into the interior of the shaft. It should be noted, however, that in many cases the reaction gas supply conduits 13*b*, 14*b* or 13*c*, 14*c* will be sufficient. In the latter case the grate shafts 13*a*, 14*a* need not be designed to be hollow shafts. The grate 14 which forms the lower end of the shaft 11 is of similar structure, being pivotable about its axis 14*a* which likewise is embodied by a hollow shaft to supply reaction gas to the discharge openings 14*b*. Below the grate 14 there is room 16 for ashes and an ashpan or receptacle 17, merely outlined in the drawing, is provided to collect them. Close to its ceiling, the shaft 11 further comprises an inlet opening 22** through which gas for drying and/or reaction gas can be fed, if necessary.

Below the lower rocking grate 14, an exhaust gas pipe 18 branches off from the shaft 11 or the room 16 for ashes. The nozzle end **18*a* of this pipe opens into a mixing chamber 19 provided at its inside wall with inlet nozzles 20 for reaction gas and opening into a combustion chamber 21 which is shown only in part. The inlet nozzles 20** are arranged at such an angle that they make sure intensive mixing occurs at this place between low temperature carbonization gas and reaction gas.

The combustion furnace illustrated operates as follows: To start the combustion process, first the material to be burnt is supplied through pipe 12 to the shaft 11, this material accumulates above the grate 13. Thus a pile or stack of material forming a cone on top deposits on the grate 13, as indicated in the drawing. Subsequently the reaction gas supply to the two grates 13 and 14 and/or the openings **13*c*, 14*c* is opened and the stack of waste material above the grate 13 is ignited by a known ignition device (not shown). The ignition takes place directly above the grate surface or the slot-type passage 15. After a certain starting phase, a fire bed forms on the grate 13. The waste which is located in the topmost range of the stack of material gets dried by the temperature which develops, promoted by drying and/or reaction gases flowing in through the opening 22, if desired. Those pieces of material which are located in the stack of waste in the central region between the drying zone and the fire bed are degasified due to the temperature transmitted from the fire bed, and those pieces of waste material in the lower region of the stack which actually are located in the fire bed or directly above it and lie in the stream of reaction gas issuing from the discharge openings 13*b* are subjected at least partly to a gasification process. The onsetting gasification process, accompanied by the beginning of dissolution of the carbon skeleton, causes the waste pieces to decompose so that they can pass the slot-type passage 15***a*. The grate 14 then causes renewed accumulation. The slot-type passage 15*b* here may be smaller in dimension than the slot-type passage 15*a* of grate 13. A fire bed develops in the bulk material collected on grate 14 and consisting of partly degasified or pre-degasified waste, due to the additional reaction gases introduced from the grate 14 through the openings 14*b* and/or the lateral openings 13*c*, 14*c* in the shaft wall. The temperatures of the fire bed are sufficiently high to result in the complete gasification of the substances of which ashes and combustible gas are formed. The ashes pass through the narrow slotted passage 15*b* and fall down into the room 16 for ashes. All the combustible gases formed in the shaft 11 are withdrawn in downward direction and removed from the shaft through conduit 18. Having passed the nozzle 18*a*, the combustible gases enter into the mixing chamber 19 were they mixed intensively with the reaction gas supplied through the nozzles 20. The mixture of combustible gas and reaction gas which has flown from the mixing chamber 19 into the combustion chamber 21 then is burnt inside the combustion chamber 21.

The reaction gas fed through the openings 13*b*, 14*b*, 13*c*, 14*c*, 22 and the nozzles 20 also may be air, or it may be flue gas obtained from the system and mixed with air or oxygen. At very high temperatures of the fire bed it may even be flue gas alone. A reaction gas consisting of flue gas or carbon dioxide and pure oxygen—instead of air—is especially effective since it contains no nitrogen. The nitrogen contained in air does not enhance burning and often leads to the formation of undesirable nitrogen oxides. The temperatures in the area directly above the upper grate 13, for instance, may range approximately from 600° C. to 800° C., directly above the lower grate 14 they may go up to approximately 900° C. The temperature in both stages is controllable by means of the reaction gas supply.

The two grates 13 and 14 preferably are excited so as to carry out rocking movements about their axes 13*a*, 14*a*. The upper grate 13 imparts mechanical thrust to the material and, as a consequence, no central voids are formed in the stack of waste material nor will burn-through happen in the outer region of the stack, even with greater shaft cross sections. The rocking movements of the lower grate 14 make sure that the formation of fine granular ashes and the conveyance of the ashes through the slot in the grate are promoted. It is convenient to excite the upper grate 13 to carry out rocking motions at higher frequency and/or amplitude than the lower grate 14.

It is an essential advantage of the invention that the drying, degasifying, and gasifying processes take place very uniformly and without any substantial peaks. If necessary, they can be accelerated so as to greatly improve both the performance and the constancy of the gas composition. The latter is particularly important if the combustible gases are intended to be used for driving a gas engine in which case the combustion chamber 21 is the combustion chamber of a gas engine. But even if the gases withdrawn from the shaft are merely burnt for reaction purposes, or partly recycled into the system to maintain the shaft temperature, and/or serve as reaction gas or to operate heat exchangers, a uniform combustion procedure is favorable. Furthermore, it proved that the intensive movement of the material caused by the moving grates and also by the reaction gas supply conduits of large cross sectional area can result in very strong reaction of the material, whereby the efficiency is increased as compared to combustion furnaces used up to now. It is likewise possible to provide the combustion furnace with reaction gas supply conduits 13*b*, 14*b* only, or with reaction gas openings 13*c*, 14*c*, only. The decision, above all, depends on the size of the combustion furnace as well as the throughput and properties of the waste material. Gas will be introduced through the upper inlet opening 22 when the waste is very moist (drying gas supply) or a fire bed is desired which reaches as far as the upper shaft zone (reaction gas supply). Finally, it is advantageous that the invention does not require the provision of central jet tubes and/or agitators inside the shaft. Additionally, travelling times for delivery and departure are reduced because less material is used. In conclusion, it should be mentioned that the term solids is understood to comprise also pasty materials and any solids mixed with liquids, such as used oil.

What is claimed is:

1. A furnace for reducing organic materials to a combustible gas comprising:

an upright shaft with an upper opening for receiving organic materials and a lower opening for discharging a combustible gas;

an upper rocking grate in said shaft for restraining the received organic materials thereabove so that they may be ignited and at least partially decomposed;

first means for injecting a reactive gas into said shaft above said upper grate for at least partially decomposing the organic materials restrained thereabove;

a lower rocking grate in said shaft for restraining the partially decomposed organic materials passed by said upper grate; and second means for injecting a reactive gas into said shaft between said upper grate and said lower grate for decomposing the organic materials restrained therebetween to a combustible gas that is vented through said lower opening.

2. The furnace of claim 1 further comprising a reaction chamber connected to said lower opening for burning the combustible gases vented therethrough.

3. The furnace of claim 1 wherein said first means comprises a covered vent from said upper grate, and wherein said upper grate comprises a hollow axle through which the reactive gas is provide to said covered vent.

4. The furnace of claim 1 wherein said first means comprises a conduit through a wall of said shaft.

5. The furnace of claim 1 wherein said upper grate rocks at a higher frequency than said lower grate.

6. A method of reducing organic materials to a combustible gas comprising the steps of:

(a) receiving organic materials to be reduced at an upper opening in an upright shaft, the upright shaft having a lower opening for discharging a combustible gas;

(b) restraining the received organic materials above an upper rocking grate in the shaft so that the organic materials may be ignited and at least partially decomposed;

(c) injecting a reactive gas into the shaft above the upper grate to at least partially decomposing the organic materials restrained thereabove;

(d) restraining the partially decomposed organic materials passed by said upper grate above a lower rocking grate in said shaft; and (e) injecting a reactive gas into the shaft between the upper grate and the lower grate to decompose the organic materials restrained therebetween to a combustible gas that is vented through the lower opening.

7. The method of claim 6 further comprising the step of burning the combustible gases vented through the lower opening in a reaction chamber connected to the lower opening.

8. The method of claim 6 wherein the reactive gas injected above the upper grate is injected through a covered vent on the upper grate, and wherein the reactive gas is provided to the covered vent through a hollow axle in the upper grate.

9. The method of claim 6 wherein the reactive gas injected above the upper grate is injected through a conduit through a wall of the shaft.

10. The method of claim 6 wherein the upper grate is vibrated at a higher frequency than the lower grate.

* * * * *